US009659528B2

(12) United States Patent
Kim

(10) Patent No.: US 9,659,528 B2
(45) Date of Patent: May 23, 2017

(54) ORGANIC LIGHT EMITTING DISPLAY DEVICE AND METHOD FOR DRIVING THE SAME

(71) Applicant: LG DISPLAY CO., LTD., Seoul (KR)

(72) Inventor: Chang-Man Kim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 63 days.

(21) Appl. No.: 14/584,585

(22) Filed: Dec. 29, 2014

(65) Prior Publication Data

US 2015/0187274 A1 Jul. 2, 2015

(30) Foreign Application Priority Data

Dec. 31, 2013 (KR) ..... 10-2013-0169476

(51) Int. Cl.
*G09G 3/3258* (2016.01)
*G09G 3/3291* (2016.01)
*G09G 3/3233* (2016.01)

(52) U.S. Cl.
CPC ..... *G09G 3/3258* (2013.01); *G09G 3/3233* (2013.01); *G09G 3/3291* (2013.01); *G09G 2300/0819* (2013.01); *G09G 2310/0289* (2013.01); *G09G 2320/029* (2013.01); *G09G 2320/0233* (2013.01); *G09G 2320/043* (2013.01); *G09G 2330/021* (2013.01)

(58) Field of Classification Search
CPC ... G09G 2300/0819; G09G 2310/0289; G09G 2320/0233; G09G 2320/029; G09G 2320/043; G09G 2330/021; G09G 3/3233; G09G 3/3258; G09G 3/3291
See application file for complete search history.

(56) References Cited

U.S. PATENT DOCUMENTS

| | | | |
|---|---|---|---|
| 2005/0078065 | A1 | 4/2005 | Hayafuji et al. |
| 2008/0297055 | A1 | 12/2008 | Miyake et al. |
| 2010/0090932 | A1 | 4/2010 | Kim |
| 2010/0103203 | A1 | 4/2010 | Choi |
| 2010/0141626 | A1 | 6/2010 | Tomida et al. |
| 2011/0134101 | A1 | 6/2011 | Yamashita et al. |
| 2013/0050292 | A1 | 2/2013 | Mizukoshi |

*Primary Examiner* — Kenneth Bukowski
(74) *Attorney, Agent, or Firm* — Birch, Stewart, Kolasch & Birch, LLP

(57) ABSTRACT

A method of compensating driving TFTs in an organic light emitting display device is discussed. According to an embodiment, the method includes applying a varied drain voltage to a drain of a specific driving TFT in one of a plurality of pixels; and compensating the specific driving TFT by the varied drain voltage, so as to maintain a constant drain-source voltage at the specific driving TFT.

13 Claims, 5 Drawing Sheets

ORGANIC LIGHT EMITTING DISPLAY DEVICE AND METHOD FOR DRIVING THE SAME

CROSS REFERENCE TO RELATED APPLICATIONS

This application claims the benefit of the Korean Patent Application No. 10-2013-0169476 filed on Dec. 31, 2013, which is hereby incorporated by reference as if fully set forth herein.

BACKGROUND OF THE INVENTION

Field of the Disclosure

Embodiments of the present invention relate to an organic light emitting display device, and more particularly, to an organic light emitting display device which is capable of reducing defects caused by a characteristic variation of a pixel and improving reliability of external compensation by reducing a sensing error, and to a method for driving the same.

Discussion of the Related Art

Recently, there is an increased interest for an organic light emitting display device owing to various advantages. In contrast to a liquid crystal display (LCD) device, the organic light emitting display device can achieve wider viewing angle, and better brightness and contrast ratio. In addition, the organic light emitting display device can emit light in itself, that is, the organic light emitting display device needs no additional backlight unit. Thus, the organic light emitting display device may be manufactured in a thin profile with a light weight, and the organic light emitting display device may have advantages of low power consumption and rapid response speed.

The pixel characteristics of the organic light emitting display device vary depending on driving time and temperature. According to a position of a compensation circuit so as to compensate for the change of the pixel characteristics, there may be an external or internal compensation method. In case of the internal compensation method, the compensation circuit is positioned inside the pixel. Meanwhile, in case of the external compensation method, the compensation circuit is positioned outside the pixel.

Due to the deviations in a process of manufacturing a thin film transistor (TFT) substrate, mobility (k) and threshold voltage of a driving TFT (DT) may vary between pixels. Accordingly, even though a data voltage (Vdata) is identically applied to the driving TFT for each of the pixels in the organic light emitting display device according to the related art, it is difficult to realize uniform picture quality due to a deviation in the electric current flowing in organic light emitting diodes (OLEDs).

In order to overcome this problem, the change in mobility (k) and threshold voltage (Vth) of driving TFT for each pixel may be sensed, and then be compensated so that a driving voltage (k*Vdata+Vth), obtained by adding a compensation voltage (Vth, k) to the data voltage (Vdata) in accordance with a video signal, may be supplied to a gate of the driving TFT.

FIGS. 1 and 2 illustrate a method for sensing the pixel characteristics for the external compensation in the organic light emitting display device according to the related art.

Referring to FIGS. 1 and 2, a method for measuring the characteristics of an OLED panel in the organic light emitting display device may be largely classified into an applied-voltage-based current measuring method and an applied-voltage-based voltage measuring method. The applied-voltage-based voltage measuring method is widely used owing to a shorter measuring time in comparison to that of the applied-voltage-based current measuring method. These methods are based on charging a source terminal of the driving TFT.

In case of the applied-voltage-based voltage measuring method as shown in <S1> of FIG. 1, a voltage is applied to the gate of a driving TFT (Tr3). A current flowing in a source terminal of the driving TFT is charged in a line cap. Thereafter, as shown in <S2> of FIG. 1, a voltage charged by turning off a switching transistor 'Tr1' is measured by an analog-to-digital converter (ADC) provided in the display device, thereby sensing the characteristics of the driving TFT.

On assumption that a current change according to a drain-source voltage (Vds) of the driving TFT is identical in a saturation area, the method for sensing the pixel characteristics according to the related art is carried out by charging a source voltage of the driving TFT, and measuring the charged value. The source voltage of the driving TFT is a voltage at the source terminal of the driving TFT, and a drain voltage of the driving TFT is a voltage at the drain terminal of the driving TFT. The drain-source voltage (Vds) of the driving TFT is a voltage across the source and drain terminals of the driving TFT.

However, in reality, a change in the amount of current flowing in the driving TFT varies depending on a variation of the drain-source voltage (Vds) by a modulation effect of a channel, which might cause incorrectness in the amount of electric current measured by the applied-voltage-based voltage measuring method according to the related art.

Also, if the source voltage of driving TFT is increased, the drain-source voltage (Vds) of the driving TFT is decreased in the related art due to the way that the drain voltage of the driving TFT is driven. As such, it is difficult to precisely sense the characteristics of the OLED panel due to the varying characteristics of the driving TFTs.

In case of the applied-voltage-based current measuring method according to the related art, it is assumed that the drain of the driving TFT is fixed to a high power line (Vdd), and the driving TFT is a constant current source. In this case, if the source terminal of the driving TFT is in high-z (high-z) state, a capacitor is fully charged by the current flowing in the driving TFT, whereby the source voltage of the driving TFT is increased.

As shown in FIG. 2 (see S2 area), by measuring the current at the source terminal of the driving TFT twice at times T1 and T2 (sampling times), it is possible to calculate the amount of current (iTFT) flowing in the driving TFT by the following Math Formula 1:

$$iTFT=C*(V2-V1)/\Delta t \qquad \text{[Math Formula 1]}$$

where C is capacitance of storage capacitor, V2 and V1 are voltages at the source terminal of the driving TFT sensed respectively at T1 and T1, and Δt equals T2 minus T1.

FIG. 3 illustrates a change in the constant current (Id) in accordance with the drain-source voltage (Vds) of the driving TFT according to the related art.

Generally, if the source voltage of the driving TFT is increased, the drain-source voltage (Vds) of the driving TFT is decreased proportionally, assuming that the driving TFT is a constant current source. However, in reality, as the drain-source voltage (Vds) of the driving TFT is decreased, the current (Id) of the driving TFT does not remain constant but is also decreased even in the saturation area as shown in FIG. 3. That is, the driving TFT is not driven as the constant current source.

That is, unlike the theory, the current (Id) of the saturation area for the driving TFT as shown in FIG. 3 is changed in accordance with the small change of the drain-source voltage (Vds), and the current (Id) is more sensitive to the change in the drain-source voltage (Vds) when the drain-source voltage (Vds) is equal to or greater than 7V. According to the increase in the source voltage of the driving TFT, a level of the drain-source voltage (Vds) of the driving TFT decreases when the fixed drain voltage is applied. In this case, the amount of current flowing for the driving TFT also varies so that it is difficult to correctly measure the amount of current flowing in the driving TFT.

SUMMARY OF THE INVENTION

Accordingly, embodiments of the present invention are directed to an organic light emitting display device and a method for driving the same that substantially obviates one or more problems due to limitations and disadvantages of the related art.

An aspect of the embodiments of the present invention is to provide an organic light emitting display device which is capable of improving reliability of external compensation by reducing a sensing error, and to provide a method for driving the same.

Another aspect of the embodiments of the present invention is to provide an organic light emitting display device which is capable of reducing defects, caused by a characteristic variation of pixels, through a precise sensing process for the characteristics of pixels, and to provide a method for driving the same.

Additional advantages and features of embodiments of the invention will be set forth in part in the description which follows and in part will become apparent to those having ordinary skill in the art upon examination of the following or may be learned from practice of embodiments of the invention. The objectives and other advantages of embodiments of the invention may be realized and attained by the structure particularly pointed out in the written description and claims hereof as well as the appended drawings.

To achieve these and other advantages and in accordance with the purpose of embodiments of the invention, as embodied and broadly described herein, there is provided in one aspect a method for driving an organic light emitting display device that may include sensing the characteristics of a driving TFT by applying a voltage to a plurality of pixels of the organic light emitting display device, wherein a drain voltage of the driving TFT varies on the basis of a change in an anode voltage of an organic light emitting diode during the sensing of the characteristics of the driving TFT formed in the plurality of pixels.

At this time, a gate-source voltage (Vgs) of the driving TFT may be sensed. Also, a driving voltage (Vdd) may vary on the basis of feedback of the anode voltage of the organic light emitting diode. Also, the anode voltage of the organic light emitting diode may be changed during the sensing of the drain voltage of the driving TFT. The drain voltage in the plurality of driving TFTs may be changed at the same time. As a variation, the drain voltage of the driving TFT may vary in a step-by-step method according to time.

In another example, the drain voltage of the driving TFT may be changed by the change in the anode voltage on the basis of the feedback of the anode voltage of the organic light emitting diode.

It is to be understood that both the foregoing general description and the following detailed description of the present invention are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this application, illustrate embodiment(s) of the invention and together with the description serve to explain the principle of embodiments of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

On explanation about the embodiments of the present invention, the following details about the terms should be understood.

The term of a singular expression should be understood to include a multiple expression as well as the singular expression if there is no specific definition in the context. If using the term such as "the first" or "the second", it is to separate any one element from other elements. Thus, a scope of claims is not limited by these terms.

Also, it should be understood that the term such as "include" or "have" does not preclude existence or possibility of one or more features, numbers, steps, operations, elements, parts or their combinations.

It should be understood that the term "at least one" includes all combinations related with any one item. For example, "at least one among a first element, a second element and a third element" may include all combinations of the two or more elements selected from the first, second and third elements as well as each element of the first, second and third elements.

Hereinafter, an organic light emitting display device and a method for driving the same according to the embodiments of the present invention will be described with reference to the accompanying drawings.

Figure 4:
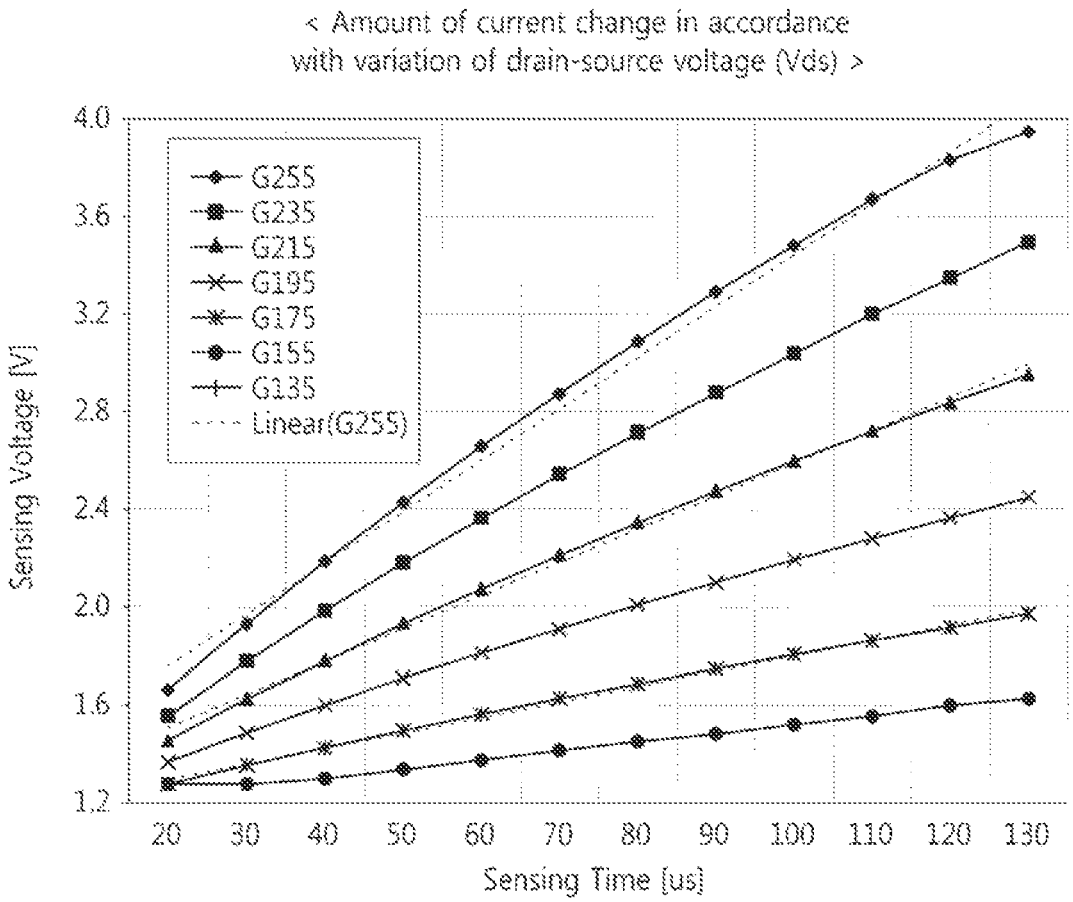
FIG. 4 illustrates a method for driving an organic light emitting display device according to an embodiment of the present invention, which shows a change in the amount of electric current in accordance with a change of drain-source voltage (Vds) of a driving TFT of the display device.

FIG. 4 illustrates a method for driving an organic light emitting display device according to an embodiment of the present invention, which shows a change in the amount of electric current in accordance with a change of drain-source voltage (Vds) of a driving TFT of the display device. The methods of FIGS. 4-6 can be applied to the circuitry/structure shown in FIG. 1 or to other suitable circuits/structures of a display device, and encompass the inventive features of the present invention. Further, these methods can be applied to various display devices or other electronic device having driving TFTs. The display device according to the present invention includes a plurality of pixels each having one or more driving TFTs, and the methods of the present invention are applied to one or more of such driving TFTs. The display devices of the present invention are operatively coupled and configured.

On the characteristics of a driving TFT (D-TFT, e.g., Tr3 in FIGS. 1-6) of the organic light emitting display device, referring to FIG. 4, an amount of change in the current flowing in the driving TFT varies depending on a variation of the drain-source voltage (Vds) of the driving TFT. Also, when a source voltage of the driving TFT is increased, a potential difference in the drain-source voltage (Vds) is decreased due to the drain voltage of the driving TFT driven. That is, if the source voltage of the driving TFT is increased, the drain-source voltage (Vds) of the driving TFT is decreased proportionally.

In the method for driving the organic light emitting display device according to an embodiment of the present invention, a drain voltage (Vdd) applied to the drain of the driving TFT is raised by a feedback of a charging value of a reference voltage (Vref). The Vdd is considered a high voltage line, whereas a Vss is considered a low voltage line. As a result, the drain-source voltage (Vds) of the driving TFT (D-TFT) can be maintained constantly so that it is possible to improve correctness in measurement using the voltage.

Figure 1:
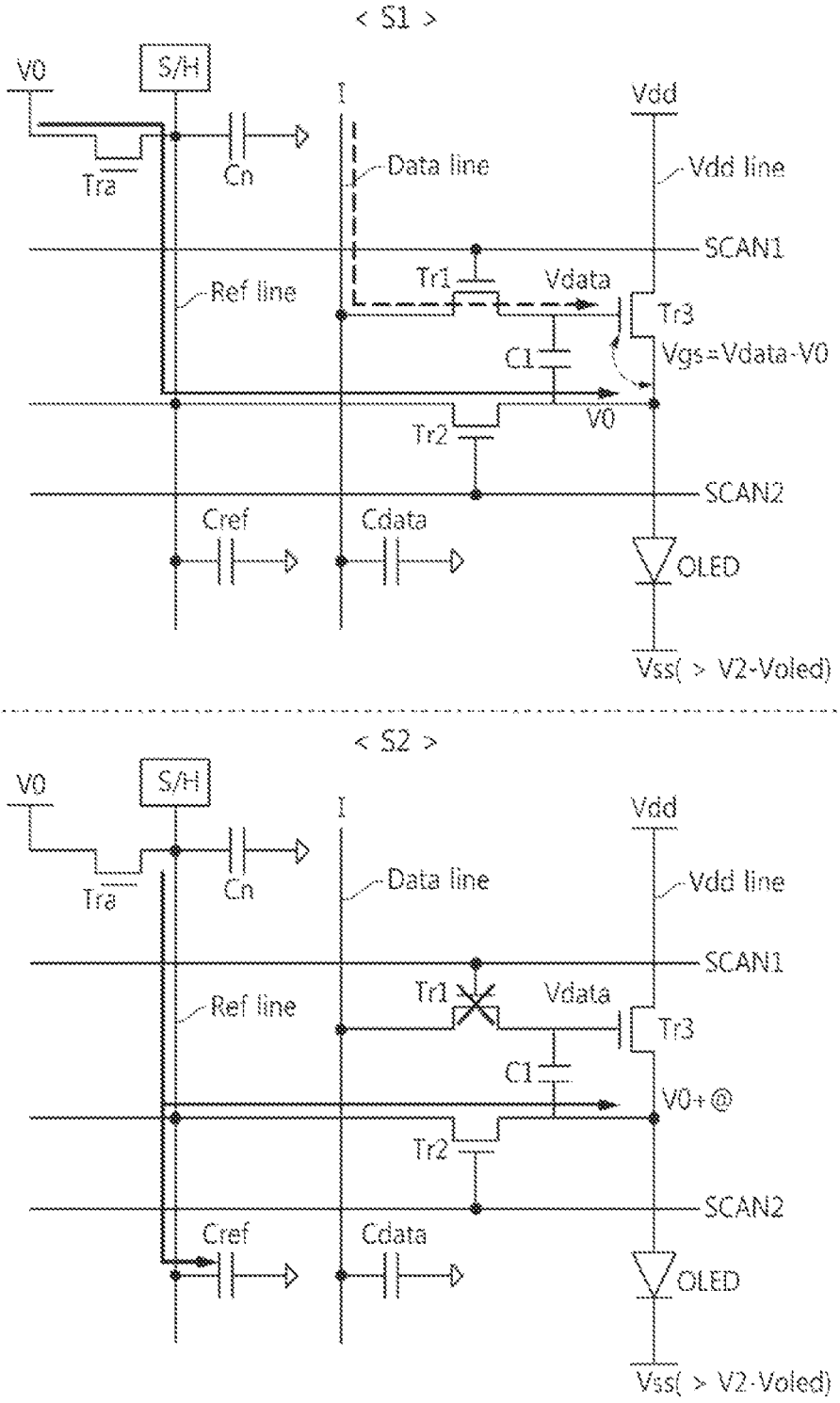
FIG. 1 Related Art
FIGS. 1 and 2 illustrate a method for sensing the pixel characteristics for an external compensation in an organic light emitting display device according to the related art.
Figure 2:
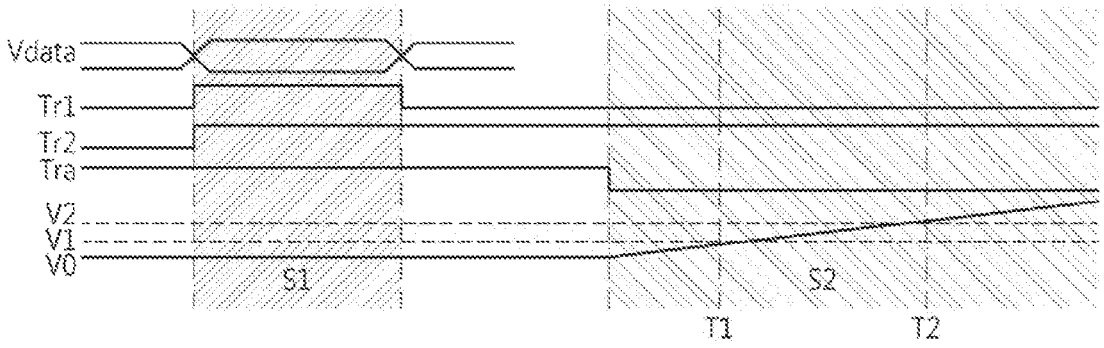
FIG. 2 Related Art
Figure 3:
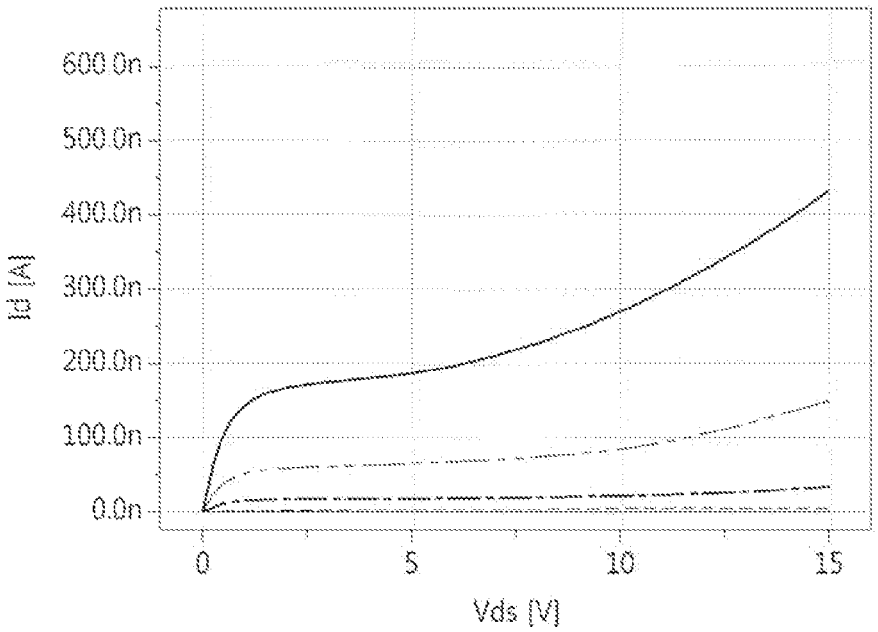
FIG. 3 illustrates a change of a constant current (Id) in accordance with a drain-source voltage (Vds) of a driving TFT according to a related art.

Referring to FIG. 1, a pixel structure of the organic light emitting display device according to the embodiments of the present invention, and a method for sensing the characteristics of pixel in the organic light emitting display device according to the present invention will be described with reference to FIG. 1. That is, the inventive features and methods of the invention can be applied to the circuits/structures of FIG. 1.

On an organic light emitting diode (OLED) panel of the display device according to an embodiment of the present invention, there are a plurality of gate lines (GL), a plurality of sensing signal lines (SL), a plurality of data lines (DL) formed parallel to each other, a plurality of driving power lines (PL), and a plurality of reference lines (RL), wherein a plurality of pixels are defined by the plurality of gate lines (GL) and data lines (DL).

Each of the pixels may include an organic light emitting diode (OLED), and a pixel circuit (PC) for making the organic light emitting diode (OLED) emit light.

The plurality of gate lines (GL) and sensing signal lines (SL) may be formed parallel to each other in a first direction (for example, a horizontal direction) of the OLED panel. In this case, a scan signal (scan/gate driving signal, e.g., SCAN1, SCAN 2 in FIGS. 1-6) is applied from a gate driver to the gate line (GL), and a sensing signal (sense) is applied from the gate driver to the sensing signal line (SL).

The plurality of data lines (DL) are formed in a second direction (for example, a vertical direction) of the OLED panel. The plurality of data lines (DL) may be disposed perpendicular to the plurality of gate lines (GL) and sensing signal lines (SL).

A driving voltage (VDD) is supplied from a data driver to the data line (DL). In this case, the driving voltage (VDD) may be obtained by adding a compensation voltage (Vth, k) for compensating for a characteristic variation of the driving TFT to a data voltage (Vdata) in accordance with a video signal.

The compensation for the characteristics of the driving TFT (threshold voltage (Vth), mobility (k)) by the use of compensation data may be performed at a power-on time point of the organic light emitting display device, or a driving period for displaying images. Also, the compensation for the characteristics of driving TFT (threshold voltage (Vth), mobility (k)) may be performed at a power-off time point of the organic light emitting display device.

The plurality of reference lines (RL) may be provided in parallel to the plurality of data lines (DL). A display reference voltage (Vref) may be selectively supplied from the data driver to the reference line (RL). In this case, the display reference voltage (Vref) may be supplied to each reference line (RL) for a data charging period of each pixel (P).

Figure 5:
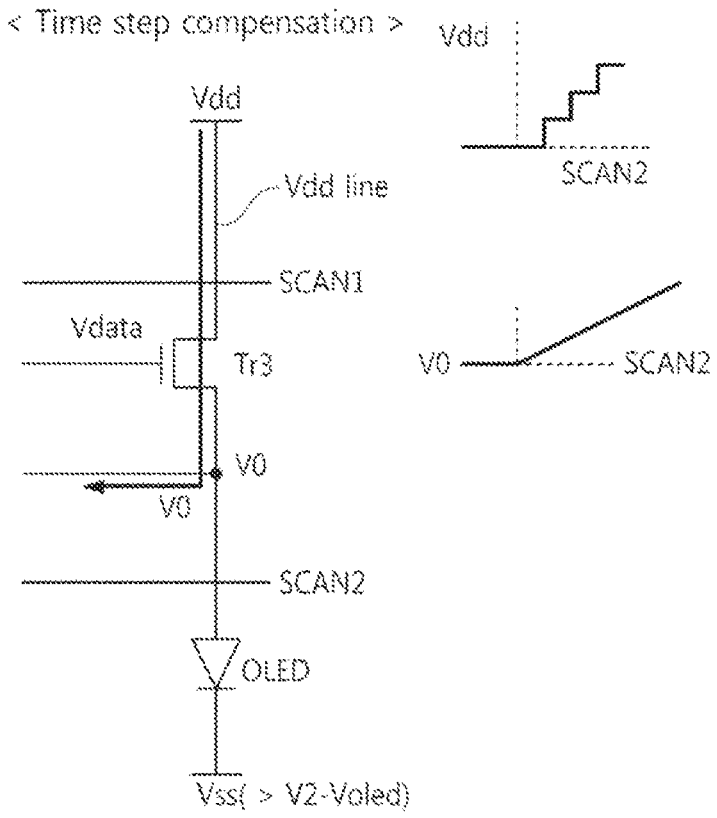
FIGS. 5 and 6 illustrate a method for driving an organic light emitting display device according to an embodiment of the present invention, which respectively shows a time step compensation method and a feedback compensation method.
Figure 6:
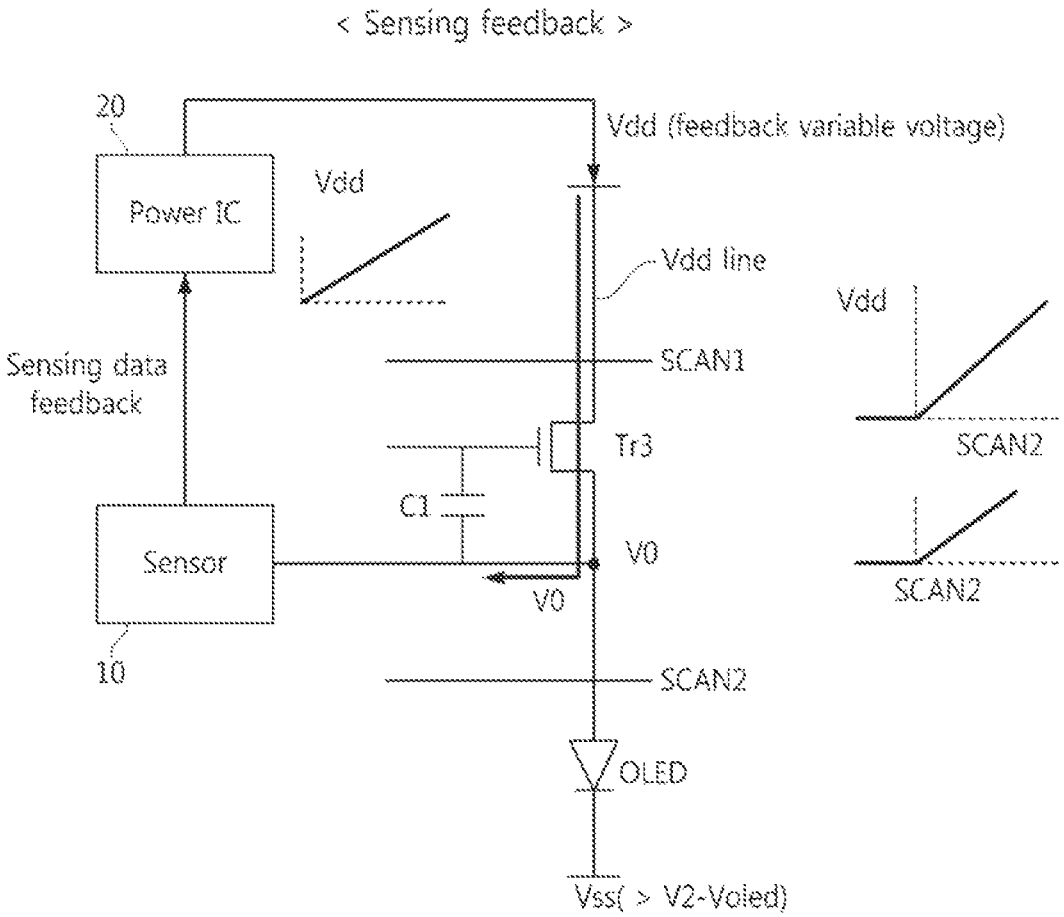

The pixel circuit (PC) may include a first switching TFT (ST1, e.g., Tr1 in FIG. 1), a second switching TFT (ST2, e.g., Tr2 in FIG. 1), a driving TFT (DT, e.g., Tr3 in FIGS. 1-6), and a capacitor (Cst). In this case, the TFTs (ST1, ST2, DT) may be P-type TFT, for example, a-Si TFT, poly-Si TFT, Oxide TFT, Organic TFT, and etc., however, the TFTs are not limited to the P-type. The above TFTs (ST1, ST2, DT) may be N-type TFTs. That is, according to the present invention, the TFTs including the driving TFTs can be N-types, P-types, or other types, e.g., in the examples of FIGS. 5-6. For instance, although the N-type driving TFTs are shown in FIGS. 5-6, if the P-type driving TFTs are used instead, Vdd from the Vdd voltage line would be applied to the source terminal of the driving TFT (e.g., Tr3) directly, and the OLED would be connected directly between the drain terminal of the driving TFT (Tr3) and the Vss voltage line.

For the display period, a digital-to-analog converter (DAC) converts digital video data into an analog data voltage (Vdata), and then supplies the analog data voltage (Vdata) to each pixel.

For the sensing period, an analog-to-digital converter (ADC) converts an analog sensing value sensed in each pixel into digital sensing data, and then supplies the digital sensing data to a timing controller of the display device.

The digital-to-analog converter (DAC) of the data driver supplies the driving voltage (VDD), which is obtained by adding the compensation voltage (Vth, k) to the data voltage (Vdata) in accordance with the video signal, to the data line of each pixel. In this case, a voltage level of the driving voltage (VDD) may be obtained by adding the compensation voltage corresponding to the characteristic change of the driving TFT (DT) of the corresponding pixel (P) to the data voltage (Vdata).

Before shipping a product manufactured with the organic light emitting display device or at any desired time, according to the present invention, it may be necessary to compensate for mura (non-uniformity in luminance) of the OLED panel of the present invention by sensing the characteristics in all the pixels by using the methods of FIGS. 5 and 6 according to the present invention.

More specifically, FIGS. 5 and 6 illustrate a method for driving the organic light emitting display device according to an embodiment of the present invention, which show respectively a time step compensation method and a feedback compensation method. In these methods, by varying the drain voltage Vdd of the driving TFT, the drain-source voltage Vds of the driving TFT is maintained at a constant or substantially constant level, which allows the measurement of the current flowing thru the driving TFT to be more precise. In one embodiment, to generate the varied drain voltage to be applied to the drain of the driving TFT, a variation in the source voltage of the driving TFT may be measured over predetermined time duration, and then the drain voltage may be varied in accordance with the sensed variation in the source voltage of the driving TFT.

In case of an external compensation, the characteristics of pixels may be individually measured so as to compensate for all the pixels. In this respect, it is important to realize a correct electric current measurement. If an incorrect electric current measurement is obtained, the compensation for the pixel becomes imprecise, which might cause degradation in the picture quality and which may result in a defective OLED panel.

According to the embodiments of the present invention, the characteristics of the driving TFT in the pixel may be sensed by applying the voltage to the pixel of the organic light emitting display device and measuring the voltage of the pixel.

According to the embodiments of the present invention, when sensing the characteristics of the driving TFT formed in the plurality of pixels, the drain voltage applied to the drain of the driving TFT may be varied so as to sense the characteristics of the driving TFT (D-TFT, e.g., Tr3 in FIGS. 5-6). For example, the drain voltage (e.g., Vdd) of the driving TFT (D-TFT) may be varied on the basis of a change in an anode voltage of the organic light emitting diode (OLED) connected to the driving TFT.

In the time step compensation method of FIG. 5, the drain voltage of the driving TFT (D-TFT or Tr3) is varied in a step-by-step method according to time so as to sense the characteristics of the driving TFT (D-TFT). For instance, the drain voltage Vdd applied to the driving TFT is increased in steps over time as shown on the right side of FIG. 5. In this case, a gate-source voltage (Vgs) of the driving TFT (D-TFT) is sensed according to the variation in the drain voltage of the driving TFT (D-TFT) over time. Having the drain voltage of the driving TFT being in a step-increased format, a more accurate sensing of the Vgs occurs, which allows a more precise detection of the variation of the driving TFT.

Meanwhile, if sensing the drain voltage of driving TFT (D-TFT, e.g., Tr3), it is possible to change the anode voltage of the organic light emitting diode (OLED).

In one embodiment of the invention, to sense the characteristics of the driving TFT (D-TFT) formed in each of all pixels, the gate-source voltage (Vgs) of the driving TFT (D-TFT) for each of the pixels is sensed by individually changing the drain voltage of the driving TFT (D-TFT) for each of the pixels.

However, it is not limited to the above method. In another embodiment of the present invention, for instance, to sense the characteristics of the driving TFT (D-TFT) formed in all the pixels, it is possible to simultaneously change all the drain voltages in the plurality of driving TFTs (D-TFT) at the same time.

According to another example, in the feedback compensation method as shown in FIG. 6, the anode voltage of the organic light emitting diode (OLED) may be fed back by the use of a sensor 10. Thereafter, a power IC 20 receives the feedback of the anode voltage, and changes the drain voltage (Vdd) for the driving TFT (Tr3) in accordance with the change in the anode voltage.

As the drain voltage (Vdd) is changed on the basis of the feedback of the anode voltage of the OLED, the drain voltage (Vdd) applied to the drain of the driving TFT (D-TFT) is varied accordingly. That is, the feedback of the anode voltage of the OLED allows the drain voltage Vdd to be varied in more accordance with the actual anode voltage of the OLED. In both methods of FIGS. 5 and 6, by varying the drain voltage Vdd of the driving TFT, the Vds (drain-source voltage) of the driving TFT can be maintained at a constant level. Thus, the characteristics of the driving TFT may be sensed more accurately by changing the drain voltage (Vdd) of the driving TFT (D-TFT).

The above methods for driving the organic light emitting display device according to the embodiments of the present invention reduce errors in the current measurement, and furthermore improve preciseness in sensing the characteristics of the driving TFTs.

Accordingly, it is possible to realize high reliability in the compensation parameters/methods, and to improve the yield of OLED panel by precisely compensating for screen mura which might be considered defects.

Also, the current flowing to the driving TFT (D-TFT) becomes insensitive to the change in the drain-source voltage (Vds) of the driving TFT. Thus, it is possible to obtain the correct measurement value for the current regardless of sensing time, to thereby improve the process margin and yield.

According to the embodiments of the present invention, it is possible to improve reliability of external compensation by reducing the sensing error in the organic light emitting display device or other types of display devices.

According to the embodiments of the present invention, it is possible to reduce defects, caused by the characteristic variation of pixels, through the precise sensing process for the characteristics of pixel in the organic light emitting display devices.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling an organic light emitting display device, the organic light emitting display device including a plurality of pixels for generating images, each of the plurality of pixels including at least one switching thin film transistor (TFT) connected to a gate line and a data line, a driving TFT connected to a high voltage line and to the at least one switching TFT, and an organic light emitting diode (OLED) connected to the driving TFT, the method comprising:

varying a voltage at the high voltage line in a step-increased format, providing the varied voltage in the step-increased format to a drain of a specific driving TFT as a drain voltage, and measuring a source voltage of the specific driving TFT to sense a variation in the source voltage over a predetermined time duration;

varying the drain voltage according to the sensed variation in the source voltage of the specific driving TFT to generate a varied drain voltage;

applying the varied drain voltage to the drain of the specific driving TFT in one of the plurality of pixels; and compensating the specific driving TFT by the varied drain voltage, so as to maintain a constant drain-source voltage at the specific driving TFT.

2. The method of claim 1, wherein the applying step applies the varied drain voltages to the driving TFTs in the plurality of pixels, simultaneously.

3. The method of claim 1, wherein in the applying step, the varied drain voltage is a drain voltage that is increased in steps over time.

4. The method of claim 3, wherein the applying step applies the varied drain voltages to the driving TFTs in the plurality of pixels, simultaneously.

5. The method of claim 1, wherein the applying step includes:

sensing, by a sensor, an anode voltage of the corresponding OLED, which has been fed back to the sensor; and generating the varied drain voltage by varying the drain voltage according to a change in the sensed anode voltage of the corresponding OLED.

6. The method of claim 5, wherein the applying step applies the varied drain voltages to the driving TFTs in the plurality of pixels, simultaneously.

7. A method for controlling an organic light emitting display device, the organic light display device including a high voltage line and a plurality of pixels for generating images, each of the plurality of pixels including at least one switching thin film transistor (TFT) connected to a gate line and a data line, a driving TFT connected to the high voltage line and the at least one switching TFT, and an organic light emitting diode (OLED) connected to the driving TFT, the method comprising:

varying a voltage at the high voltage line in a step-increased format, providing the varied voltage in the step-increased format to a drain of a specific driving TFT, and measuring a source voltage of the specific driving TFT to sense a variation in the source voltage over a predetermined time duration;

varying the voltage at the high voltage line according to the sensed variation in the source voltage of the specific driving TFT to generate a varied drain voltage;

generating the varied drain voltage at the high voltage line;

applying the varied drain voltage to the drain of the specific driving TFT in one of the plurality of pixels; and compensating the specific driving TFT by the varied drain voltage, so as to maintain a constant drain-source voltage at the specific driving TFT.

8. The method of claim 7, wherein the applying step applies the varied drain voltage from the high voltage line to the source of the specific driving TFT.

9. The method of claim 7, wherein the applying step applies the varied drain voltage to the driving TFTs in the plurality of pixels, simultaneously.

10. The method of claim 7, wherein in the applying step, the varied drain voltage is a drain voltage that is increased in steps over time.

11. The method of claim 10, wherein the applying step applies the varied drain voltage to the driving TFTs in the plurality of pixels, simultaneously.

12. The method of claim 7, wherein the applying step includes:

sensing, by a sensor, an anode voltage of the corresponding OLED connected to the specific driving TFT, which has been fed back to the sensor, wherein the generating step generates the varied drain voltage by varying the voltage from the high voltage line according to a change in the sensed anode voltage of the corresponding OLED.

13. The method of claim 12, wherein the applying step applies the varied drain voltage to the driving TFTs in the plurality of pixels, simultaneously.

* * * * *